US007411174B2

(12) United States Patent
Eash

(10) Patent No.: US 7,411,174 B2
(45) Date of Patent: Aug. 12, 2008

(54) SENSOR-CONTROLLED LED ARRAY APPARATUS AND METHOD

(76) Inventor: Brandon A. Eash, 124 Babcock St., Apt. 25, Brookline, MA (US) 02446

( * ) Notice: Subject to any disclaimer, the term of this patent is extended or adjusted under 35 U.S.C. 154(b) by 0 days.

(21) Appl. No.: 11/247,444

(22) Filed: Oct. 11, 2005

(65) Prior Publication Data

US 2006/0086888 A1 Apr. 27, 2006

Related U.S. Application Data

(60) Provisional application No. 60/617,968, filed on Oct. 12, 2004.

(51) Int. Cl.
*F21V 23/04* (2006.01)

(52) U.S. Cl. ..... 250/221; 250/205; 362/133; 340/545.1

(58) Field of Classification Search ..... 250/221, 250/205; 340/540, 541, 550–567, 545.1, 340/545.3; 362/103.1
See application file for complete search history.

(56) References Cited

U.S. PATENT DOCUMENTS

| | | | | |
|---|---|---|---|---|
| 3,867,621 | A | 2/1975 | Gewfrtz et al. | |
| 4,812,810 | A * | 3/1989 | Query | 340/545.3 |
| 5,032,957 | A | 7/1991 | Canfield | |
| 5,193,895 | A | 3/1993 | Naruke et al. | |
| 5,246,285 | A | 9/1993 | Redburn et al. | |
| 5,276,595 | A * | 1/1994 | Patrie | 362/101 |
| 5,319,903 | A | 6/1994 | Holland | |
| 5,321,593 | A | 6/1994 | Moates | |
| 5,580,155 | A | 12/1996 | Hildebrand et al. | |
| 5,661,374 | A | 8/1997 | Cassidy et al. | |
| 5,717,179 | A | 2/1998 | Meyer | |
| 5,848,837 | A | 12/1998 | Gustafson | |
| 5,893,627 | A | 4/1999 | Tague | |
| 6,113,248 | A | 9/2000 | Mistopoulos et al. | |
| 6,173,517 | B1 | 1/2001 | Eibner et al. | |
| 6,601,984 | B2 * | 8/2003 | Yamamoto | 362/600 |
| 2006/0010601 | A1 * | 1/2006 | Riley | 5/600 |

OTHER PUBLICATIONS

Heads Up Technologies: "LED cabin lighting", www.heads-up.com.
Emteg: "LED cabin lighting", www.emteq.com.
Skyvision: "Wireless Cabinet Light", www.skyvision.com (see attachment).
Greenlite—"LED MotionSensor Light", www.greenliteusa.com (see attachment).

* cited by examiner

*Primary Examiner*—Georgia Y. Epps
*Assistant Examiner*—Tony Ko
(74) *Attorney, Agent, or Firm*—Barnes & Thornburg LLP

(57) ABSTRACT

An apparatus for selectively emitting light is provided. The apparatus has at least one light-emitting diode (LED) for emitting light. and a sensor that responds to the presence of a signal, such as infra-red light. The apparatus has a controller that controls the activation of the at least one LED based upon the sensor response.

7 Claims, 7 Drawing Sheets

40
31
C1
D3
Q4
R7
L1
Vcc
VDRV
GND
Isns
SHDN
+4.5V
3V
R24
120
U6
IN+
GND
IN-
OUT
112
R20
R22
118
R18
U8
116
114
R13
R14
J4
CLK
DATA
GND
Vcc
Vpp
U7
Vss
RB0
RB1
RB2
RC0
RC1
RC2
VDD
OSC1
OSC2
GP3/MCLR
RC5
RC4
RC3
X1
C4
C5
D1
R3
C9
Q2
R6
R2
Q1
U3
Co
Em
34
32
R1
U5
VIN
VOUT
C8
C7
SW2
R12
D4
J1

SENSOR-CONTROLLED LED ARRAY APPARATUS AND METHOD

RELATED APPLICATIONS

The present application is related to and claims priority to U.S. Provisional Patent Application Ser. No. 60/617,968, filed on Oct. 12, 2004, entitled SENSOR CONTROLLED LED ARRAY. The subject matter disclosed in that provisional application is hereby expressly incorporated into the present application.

FIELD OF THE INVENTION

The present disclosure relates to the field of lighting apparatus, and more particularly to, a sensor-controlled light-emitting diode (LED) light array.

BACKGROUND AND SUMMARY

Storage spaces, such as cabinets, are typically unlit. The spaces may not be wired for lighting or may be too small to install after-market permanent lighting. These spaces could be lit by a portable light strip, capable of being positioned within the space and able to adequately light it. The light strip, once positioned, may be activated by a sensor so that illumination occurs upon a desired "on" condition, such as the cabinet door opening. The sensor may also turn off the light strip when the cabinet door closes, recognizing the "off" condition or after a preselected time interval in order to conserve energy. Sensors using physical contact to sense "on/off" conditions, such as plunger switches currently exist. These types of switches may require specific orientations or locations to allow the physical contact. "Smart" sensors, such as optical sensors, provide more flexibility requiring merely line-of-sight to recognize on/off conditions, such as a cabinet door opening/closing. The use of light-emitting diodes (LED's) for illumination typically provide a more efficient light source than filament or fluorescent based lighting. The increased efficiency may provide a longer life span for a disposable or rechargeable power supply, such as a battery.

In an illustrative embodiment of the present disclosure, an LED array comprises a plurality of LED's attached to a strip and a sensor for activating the LED strip. Activation of the array illuminates the plurality of LED's. In another illustrative embodiment, the strip is selectively fastenable to various surfaces using fasteners, such as adhesives or screws, for example. The fasteners allow the LED array to be positioned within areas that may require lighting, such as cabinets.

In another illustrative embodiment, the sensor, e.g., an optical sensor, recognizes a desired "on" condition for activating the LED strip, such as when a cabinet door opens, for example. The sensor also recognizes a desired "off" condition, such as when the cabinet door closes. The sensor can also illustratively be configured to deactivate the LED strip after a preselected interval of time has elapsed. In another illustrative embodiment, an infra-red (IR) light sensor can be used to detect "on/off" conditions for the LED strip. In another illustrative embodiment, a controller can be used in connection with other circuitry to control an LED array based upon the response provided by a sensor. In another illustrative embodiment, the controller can be used to intermittently power the IR light sensor allowing power consumption to be reduced.

In another illustrative embodiment, the LED array includes an ambient light detection circuit. The ambient light detection circuit is used to detect the situation when the IR sensor is saturated by ambient light, which can cause the LED array to be deactivated even when the IR sensor is not receiving infra-red light from the infra-red light source.

In another illustrative embodiment, the strip may be tethered to the sensor allowing the same to be spaced apart from the strip. This embodiment, for example, may allow the strip to fasten to a cabinet's ceiling, while the sensor is positioned to monitor the opening/closing of the cabinet door. In another illustrative embodiment, the sensor, LED's, and any control circuitry are all contained within a housing. The housing is selectively fastenable to surfaces such as a cabinet ceiling, for example. The LED's are directed at the cabinet interior and the sensor faces the associated cabinet door. The sensor recognizes the cabinet door is opened causing activation of the LED's. In another illustrative embodiment, the sensor is integrally formed with the strip, allowing the strip to be portable and used in a fashion such as a flashlight. In another illustrative embodiment, the LED's are driven by a high-efficiency circuit configured to minimize power consumption from a battery pack, or other power-supplying device.

Additional features and advantages of the sensor-controlled LED array will become apparent to those skilled in the art upon consideration of the following detailed descriptions exemplifying the best mode of carrying out the sensor-controlled LED array as presently perceived.

BRIEF DESCRIPTION OF THE DRAWINGS

The present disclosure will be described hereafter with reference to the attached drawings which are given as non-limiting examples only, in which.

Figure 1:
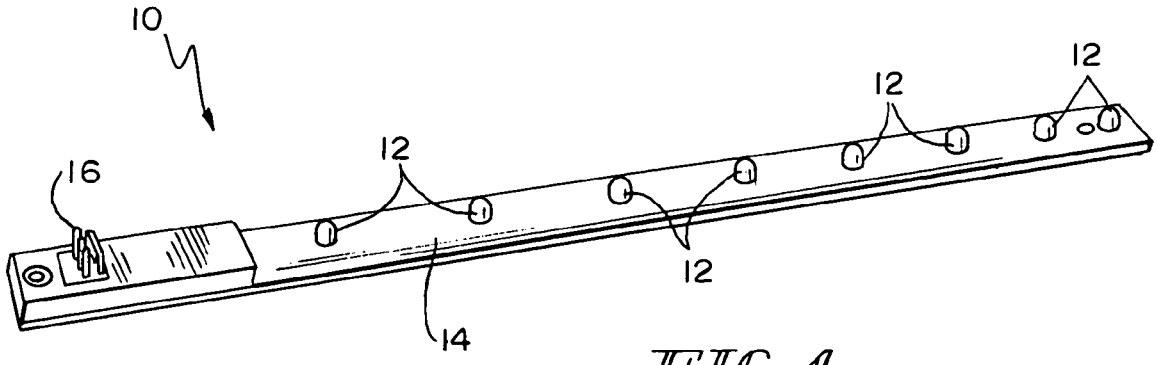
FIG. 1 is a perspective view of an illustrative embodiment of a portion of an LED array.

Corresponding reference characters indicate corresponding parts throughout the several views. The exemplification set out herein illustrates embodiments of the sensor-controlled LED array, and such exemplification is not to be construed as limiting the scope of the sensor-controlled LED array in any manner.

DETAILED DESCRIPTION OF THE DRAWINGS

A perspective view of an illustrative embodiment of a portion of LED array 10 is shown in FIG. 1. LED array 10 includes a plurality of LED's 12. LED's 12 are illustratively positioned on LED strip 14. LED array 10 also includes port 16, which is selectively connectable to a sensor, such as sensor 22, for example. (See, also, FIG. 2.) While LED strip 14 is illustratively shown to be rectangularly shaped, it is appreciated that LED strip 14 can be formed to various shapes, such as circular or hemispherical, for example, allowing various distributions of any number of LED's 12 to be positioned thereon.

Figure 2:
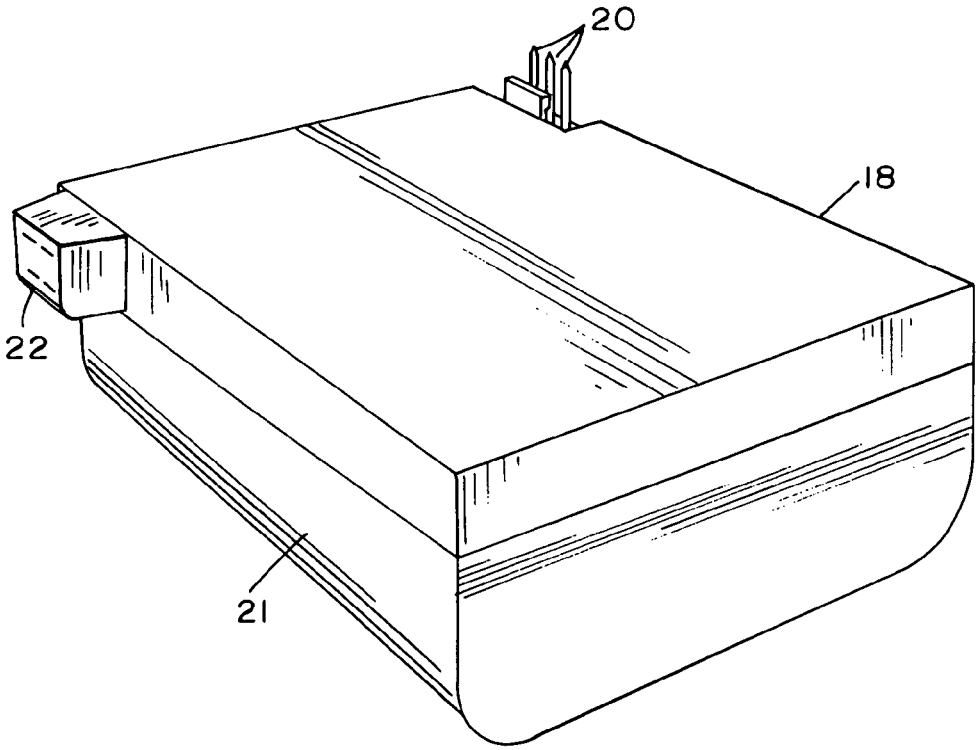
FIG. 2 is a perspective view of an illustrative embodiment of another portion of the LED array of FIG. 1.
Figure 3:
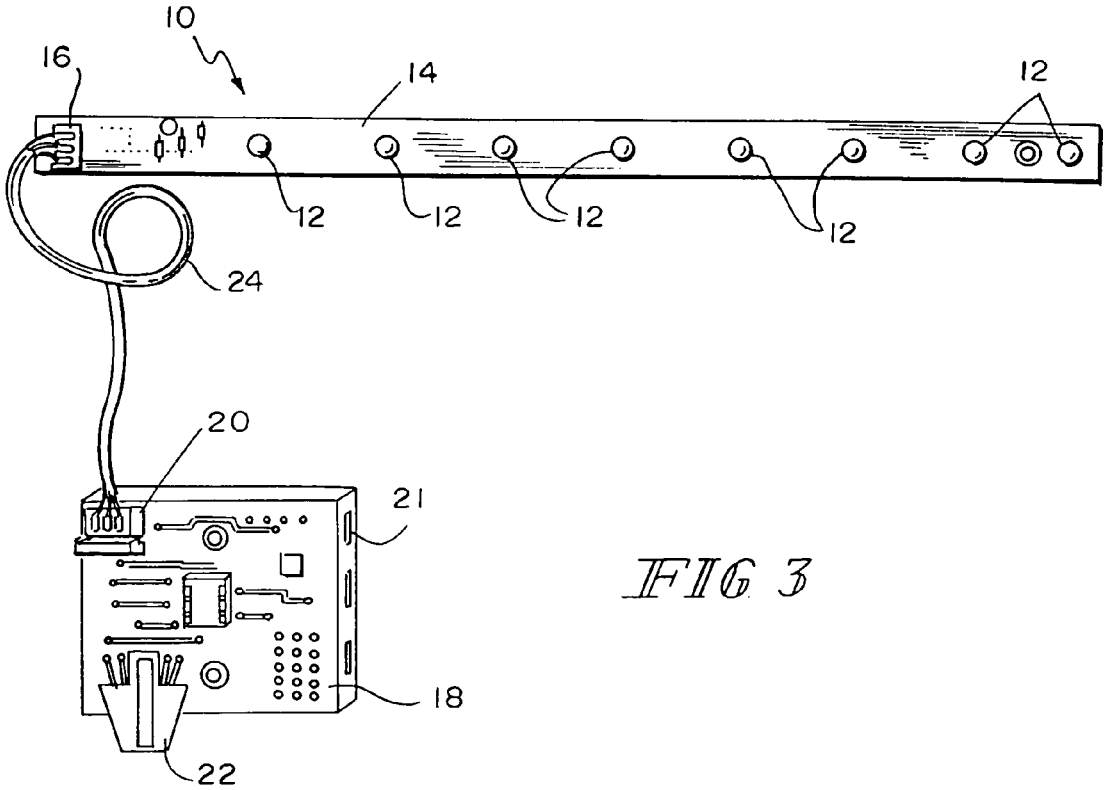
FIG. 3 is a component view of an illustrative embodiment of an LED array.

A perspective view of an illustrative embodiment of another portion of LED array 10 is shown is FIG. 2. Sensor board 18 includes control circuitry, which activates/deactivates LED strip 14. Sensor board 18 is located on battery housing 21. Battery housing 21 illustratively contains batteries for powering LED array 10. Sensor board 18 is selectively connectable to LED strip 14. (See, also, FIGS. 3-4.) Sensor board 18 includes sensor 22. Sensor board 18 also includes terminals 20, which connect to LED strip 14. A component view of an illustrative embodiment of LED array 10 with LED strip 14 tethered to sensor board 18 is shown in FIG. 3. In this illustrative embodiment, tether 24 comprises a control cable connecting LED strip 14 to sensor board 18. Tether 24 is connected at port 16 of LED strip 14 and at terminals 20 of sensor board 18. Sensor 22 is shown connected to sensor board 18. Sensor board 18 is illustratively shown to be positioned on battery housing 21. In this illustrative embodiment, battery housing 21 contains three AAA batteries to power LED array 10. It is appreciated, however, that various-sized battery cells may be used, as well as alternative power supplies, for example.

Figure 4:
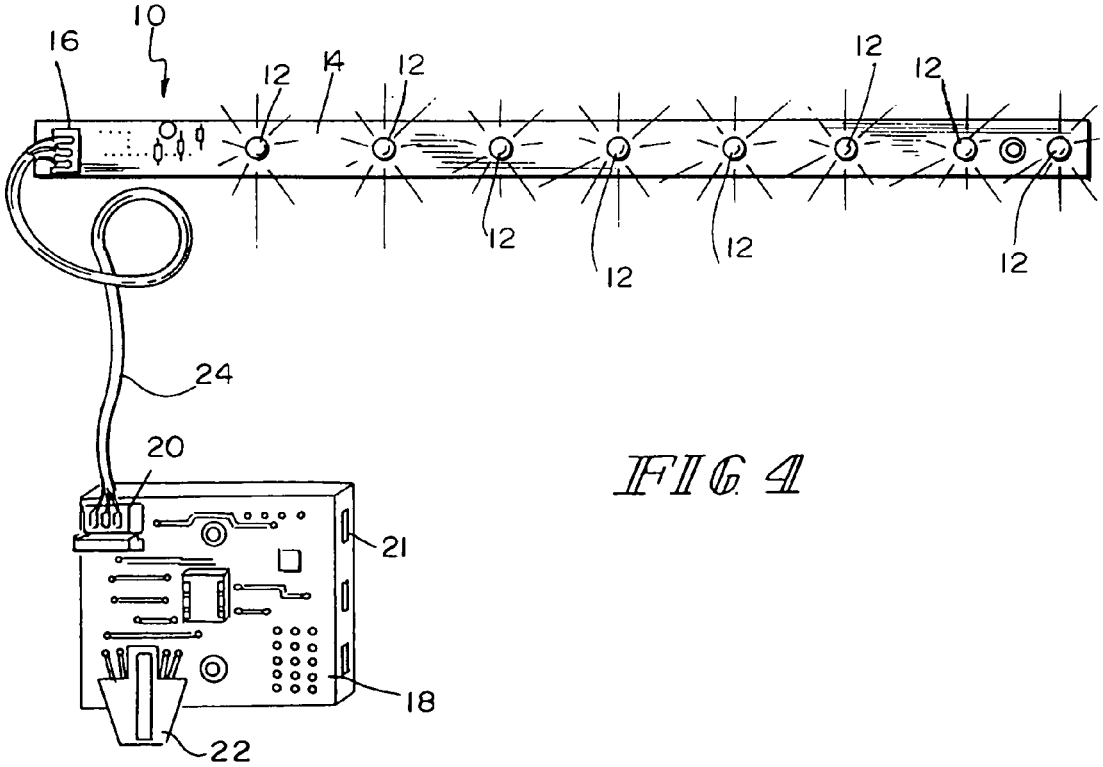
FIG. 4 shows another component view of the illustrative embodiment of the LED array shown in FIG. 3.

LED array 10 with LED's 12 illuminated is shown in FIG. 4. LED's 12 are illuminated when sensor 22 detects the desired "on" condition to transmit a signal through tether 24 illuminating LED's 12. It is appreciated that LED strip 14 of LED array 10 can be selectively fastened to multiple surfaces through fasteners, such as adhesives or screws, for example.

Figure 5:
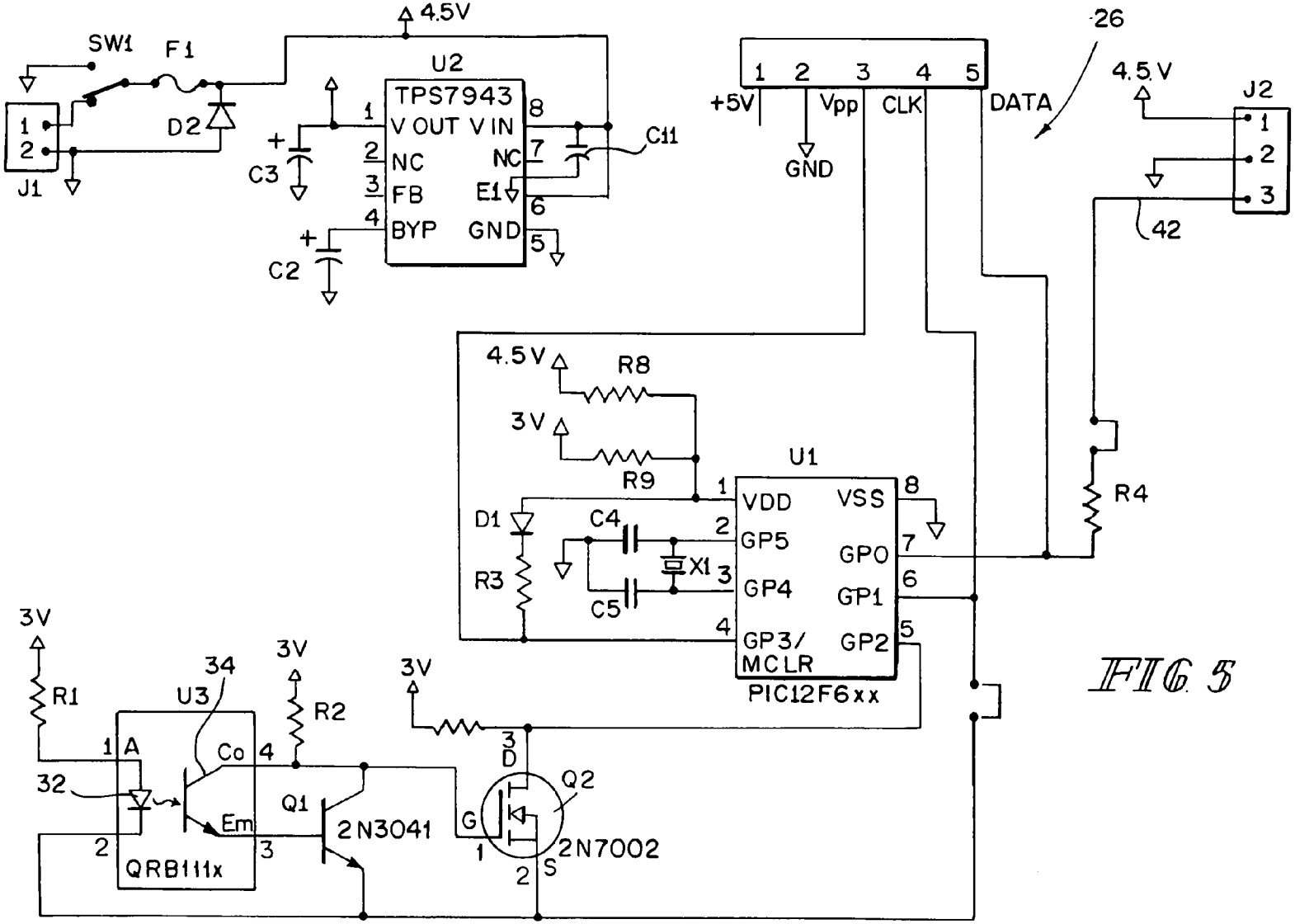
FIG. 5 is a schematic view of an illustrative embodiment of a portion of a control circuit used to control an LED array.

A circuit schematic showing a portion of an illustrative control circuit 26, which is responsible for activating/deactivating LED's 31 is shown in FIG. 5. (See, also, FIG. 6.) Fuse F1 and diode D2 provide reverse battery protection to the circuit. Battery J1 is also connected to linear regulator U2. Regulator U2 receives an illustrative 4.5 volts from battery J1 and regulates an output voltage of regulator U2 to a stable 3.0 volts. Light connector J2 allows cabling to route control signals and power to LED's 31. (See, also, FIG. 6.)

Microprocessor U1 enables sensor U3, reads the state of U3, and activates/deactivates LED's 31. Microprocessor U1 is also responsible for deactivating LED's 31 after they have been on for a predetermined time interval. Oscillator X1 provides a clocking signal for microprocessor U1. Capacitors C4 and C5 are used to operate oscillator X1. Resistor R4 is connected between microprocessor U1 and enable line 42 of light connector J2 to provide current-limiting protection to microprocessor U1 in the event of a short circuit occurring at light connector J2.

Sensor U3 is illustratively an IR-based sensor. Sensor U3 uses an IR light-emitting diode (IRLED) 32 to sense the "on/off" conditions for LED array 10. Resistor R1 regulates the current through IRLED 32. When sensor U3 is receiving its reflected emitted light, LED's 31 are in the "off" state. The receipt of reflected IR light causes transistor 34 of sensor U3 to conduct current. The current through transistor 34 flows into the base of transistor Q1. Transistor Q1 is connected to transistor 34 to allow the emitter current through transistor 34 to be amplified. The collector of transistor Q1 is connected to the gate of transistor Q2. When sensor U3 senses the "off" condition, current is flowing through transistor Q1. This makes the collector voltage of transistor Q1 low, thus making the gate voltage of transistor Q2 low, therefore transistor Q2 does not conduct. When sensor 32 senses the "on" condition, transistor Q1 no longer conducts. This increases the collector voltage of transistor Q1, thus increasing the gate voltage of transistor Q2. This allows transistor Q2 to conduct, thereby lowering the drain voltage of transistor Q1. The drain of transistor Q2 is connected to pin GP2 of microprocessor U1. The raising and lowering of the drain voltage of transistor Q2 is seen by pin GP2 as a logic high/low signal. This signal allows microprocessor U1 to determine when LED's 31 should be illuminated. Resistors R2 and R6 limit current and place transistors Q1 and Q2, respectively, into near-saturation state. In another illustrative embodiment, sensor U3 can be intermittently powered so that it checks for the "on/off" conditions periodically, as opposed to constantly. This allows power to be conserved to extend the life of a disposable power supply, such as a battery.

Figure 6:
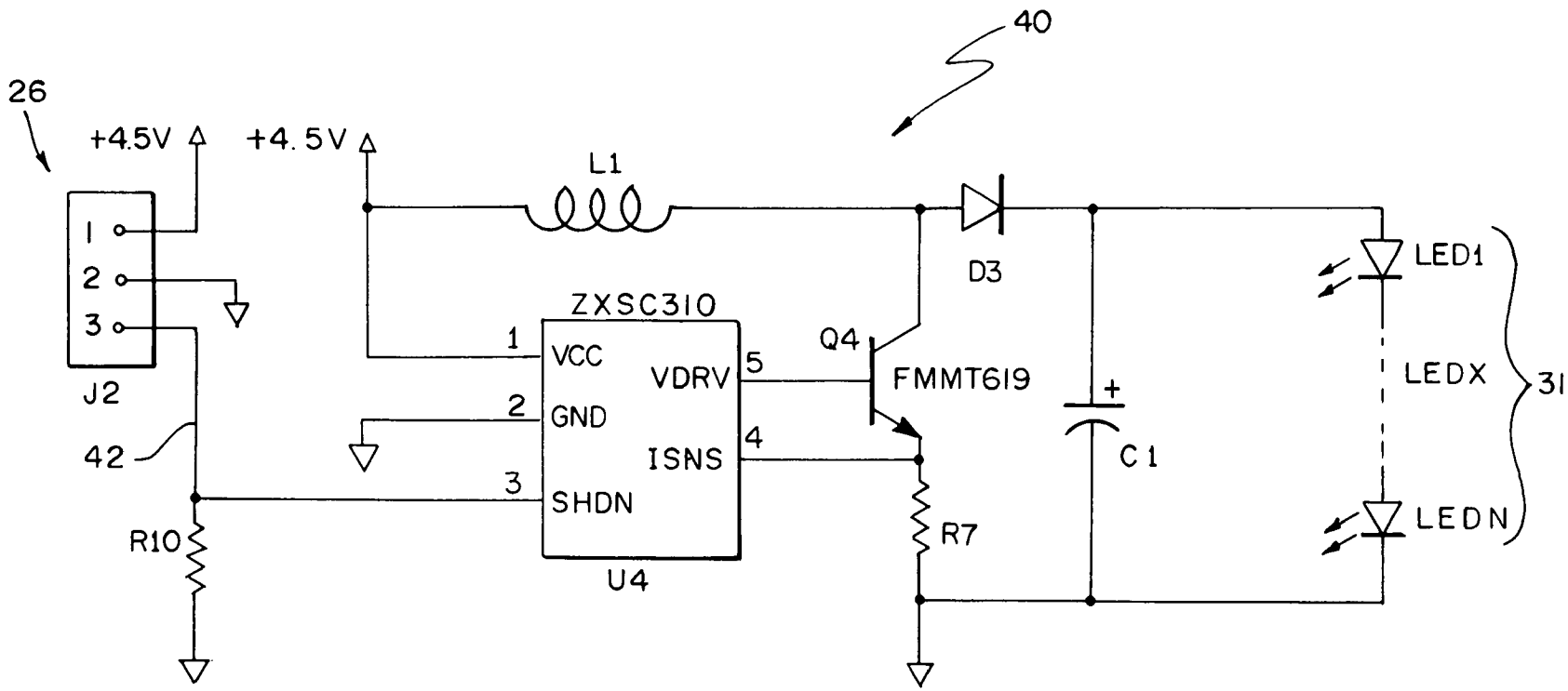
FIG. 6 is a schematic view of an illustrative embodiment of another portion of a control circuit used to control an LED array.

Illustratively shown in FIG. 6 is a schematic drawing of another portion of control circuit 26, specifically LED driver circuit 40. Driver circuit 40 uses driver chip U4, illustratively shown as a ZXSC310 LED driver by Zetex PLC. Driver circuit 40 is designed in accordance with the Zetex application notes for the ZXSC310 and boosts its input voltage to activate the LED's 31. Enable line 42 of light connector J2 (see, also, FIG. 5) is connected to driver chip U4. Enable line 42 connects to pin SHDN of driver chip U4 to pin GP2 of microprocessor U1 to receive the "on/off" signal. A logic high will enable chip U4 to activate LED's 31. A logic low deactivates LED's 31. Resistor R2 ensures pin SHDN does not see a logic high in the event that enable line 42 becomes disconnected from pin SHDN.

When chip U4 reads a logic low, pin $V_{drv}$ does not supply a voltage to transistor Q4. This makes any current flowing into LED's 31 minimal, with capacitor C1 acting as an open circuit. When LED's 31 need to be illuminated, chip U4 reads a logic high from enable line 42. This causes pin $V_{drv}$ to turn on transistor Q4. Chip U4 uses its pin $I_{sns}$ to sense the voltage at resistor R7. At the same time, current begins building up through inductor L1, which also flows through capacitor Cl causing it to charge up. When the current through transistor Q5 reaches a certain point, chip U4 reduces the voltage at pin $V_{drv}$. Inductor L1 cannot immediately reduce the current, causing a large voltage to build up across it. This boost in voltage is seen by LED's 31 and is high enough to activate them. After a given time interval, pin $V_{drv}$ goes high again and transistor Q4 conducts, reducing the voltage at LED's 31. This described cycle repeats at a high frequency, thus keeping LED's 31 illuminated. When pin SHDN reads a low signal from enable line 42, chip U4 shuts off, thus deactivating LED's 31

Figure 7:
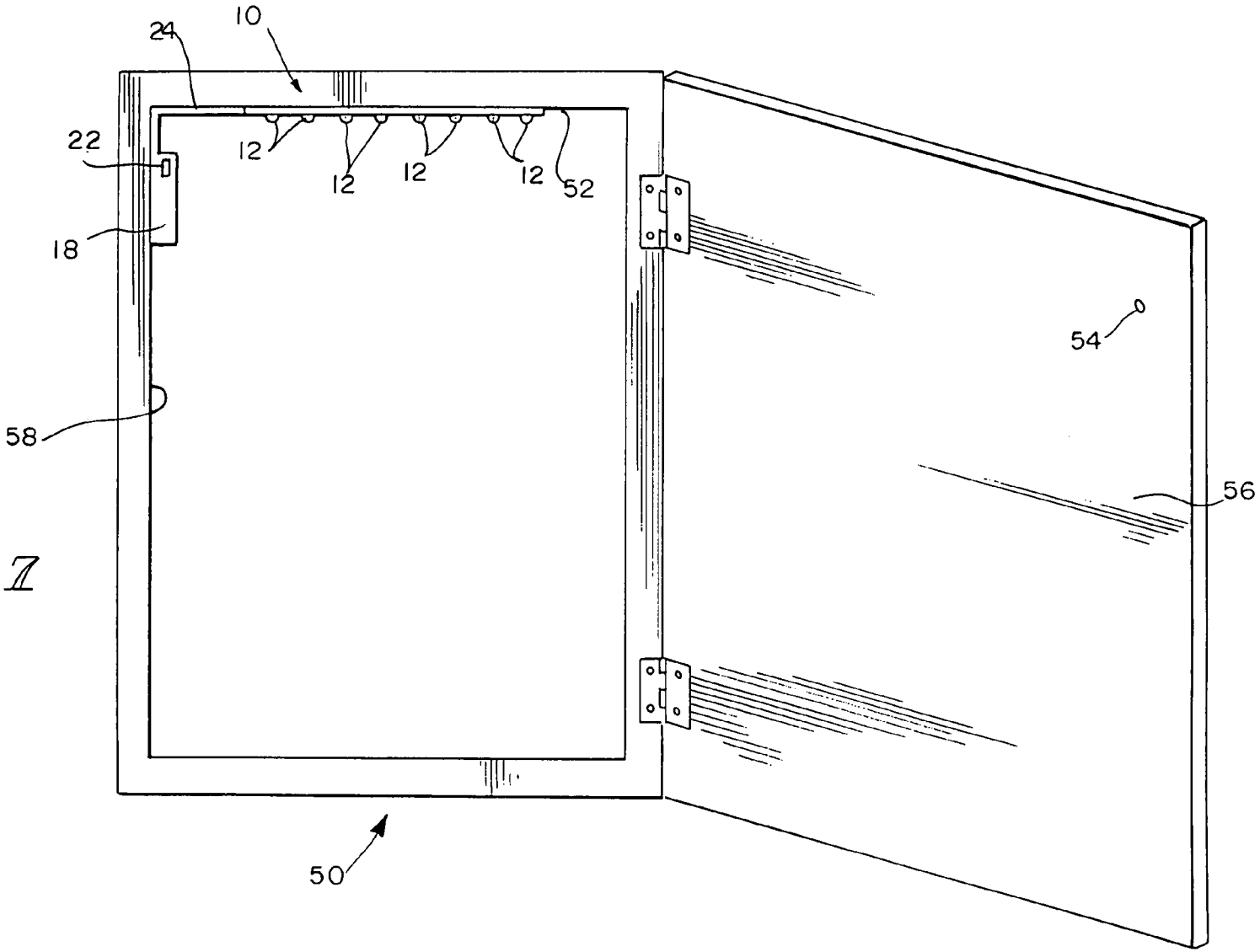
FIG. 7 is a perspective view of an illustrative embodiment of a sensor controlled LED array and a reflective surface being used with an illustrative cabinet.

Illustratively shown in FIG. 7 is a drawing of LED array 10 positioned within cabinet 50. LED strip 14 is shown fastened to ceiling 52 of an illustrative cabinet 50. Tether 24 is connected to both sensor board 18 and LED array 10. Reflector 54 is positioned on door 56 of cabinet 50 and sensor board 18 is positioned on wall 58 of cabinet 50. Reflector 54 allows the IR light emitted by sensor 22 to be reflected back into sensor 22, so that sensor 22 senses the "off" condition when door 56 is closed. However, in other illustrative embodiments, no reflector is necessary and the opposing surface, i.e., cabinet door, may act as the reflecting surface for the infra-red light signal. When door 56 opens, as illustratively shown in FIG. 7, LED array 10 activates, illuminating LED's 12. LED's 12 stay illuminated until a predetermined time interval expires, deactivating LED array 10. Control circuit 26 resets upon closing door 56, so that LED array 10 activates when door 56 is opened again.

Figure 8:
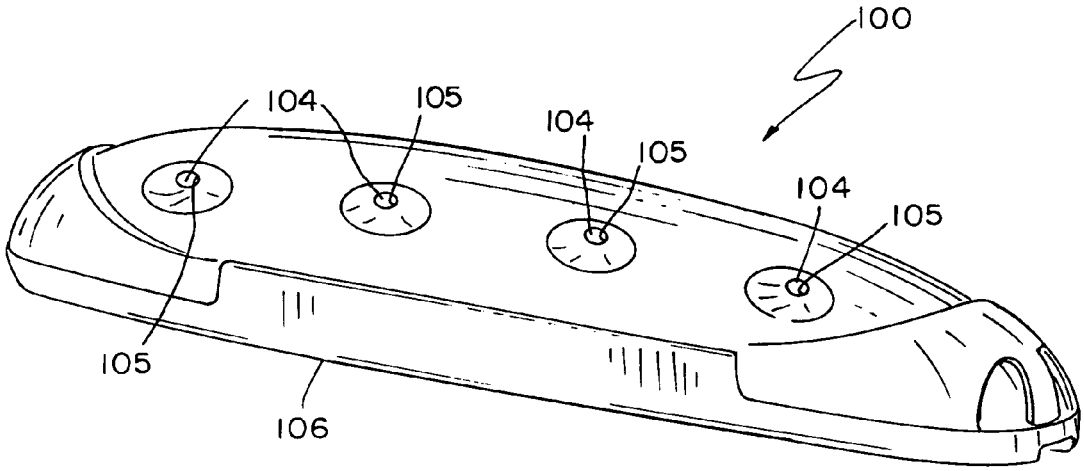
FIG. 8 is a perspective view of another illustrative embodiment of an LED array.
Figure 9:
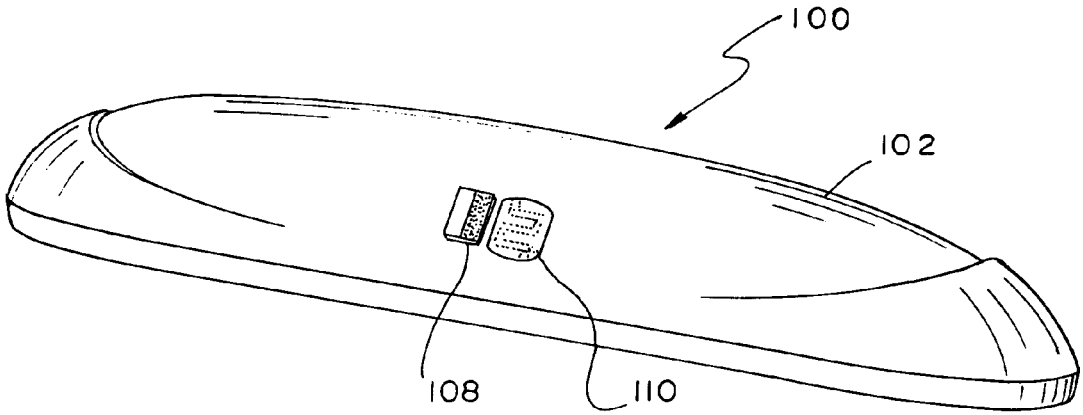
FIG. 9 is another perspective view of the illustrative embodiment of the LED array shown in FIG. 8.

A perspective view of another illustrative embodiment of an LED array 100 is shown in FIG. 8. Unlike LED array 10, LED array 100 includes housing 102, which houses the control circuitry and LED's 104. LED's 104 are each disposed within a respective opening 105 of housing 102. Surface 106 of housing 102 can be used to selectively fasten housing 102 to a surface using fasteners such as those described regarding LED array 10. FIG. 9 shows another perspective view of LED array 100. This view shows a IR sensor 108 and ambient light sensor 110. (See, also, FIG. 10.) LED array 100 can be selectively fastened to a surface, such as a cabinet ceiling 52, allowing a cabinet door, such as cabinet door 56, to be used as a reflection surface with IR sensor 108 being used in conjunction therewith to operate LED array 100 in a manner similar to that described regarding LED array 10.

Figure 10:
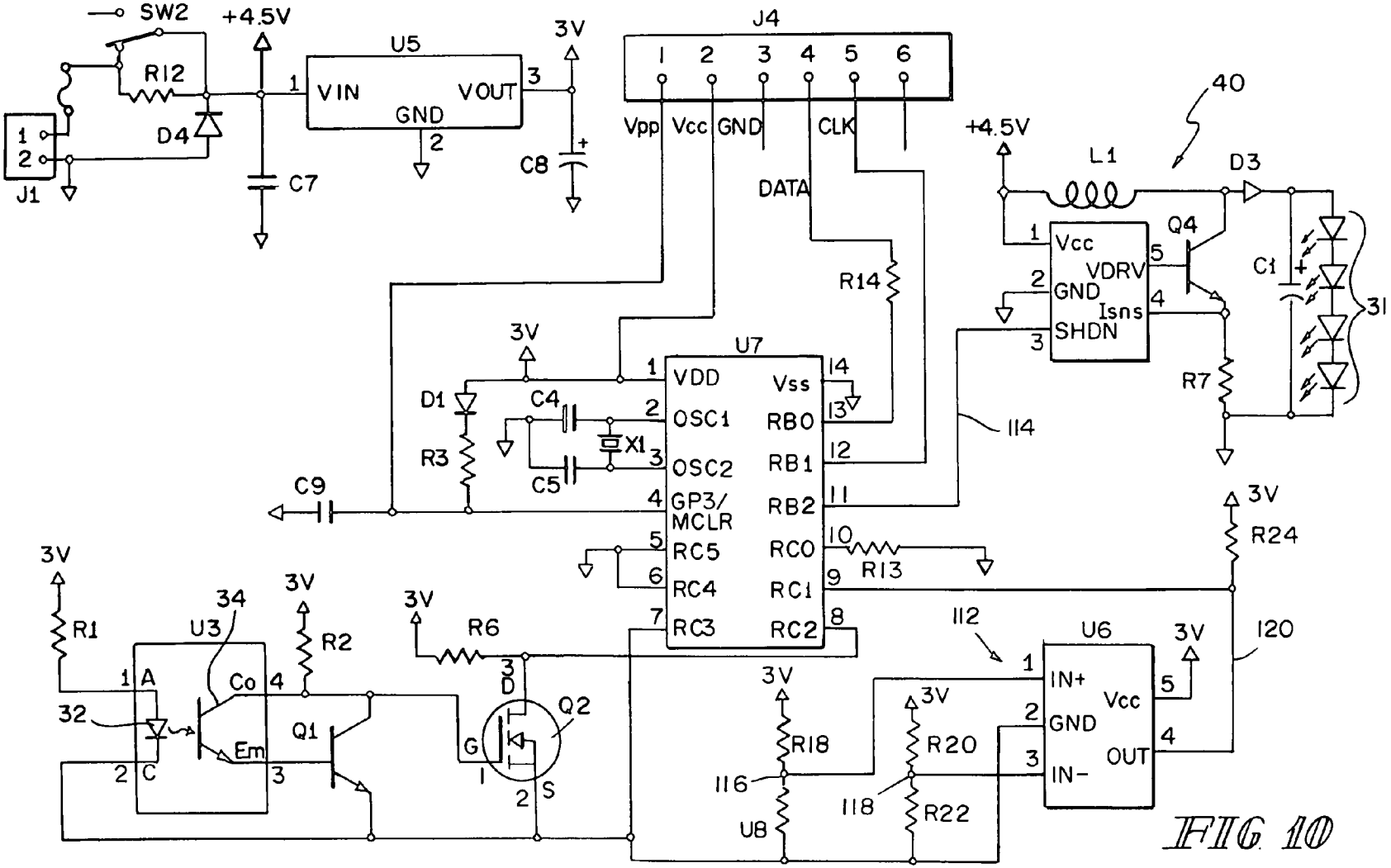
FIG. 10 is a schematic view of an illustrative embodiment of another control circuit used to control an LED array.

A schematic of a portion of control circuitry that can be used to control LED array 100 is shown in FIG. 10. Many components and configurations shown in FIG. 10 are similar to those show in FIGS. 5 and 6. For example, IRLED 32 and its associated circuitry described in FIG. 5, as well as LED driver circuit 40 shown in FIG. 6 can be used. In this illustrative circuit, however, microprocessor U7 is directly connected to LED driver circuit 40 through enable line 114.

Battery J1 and fuse F1 as shown in FIG. 10, are similar to that used in FIG. 5. Switch SW2 is used with linear regulator U5, similar to linear regulator U2, to receive the illustrative 4.5 volts of battery J1 to provide a regulated 3.0 volts for control circuit 111 to use. Fuse F1 resistor R12, and diode D4 are used for reverse battery connection. Capacitors C7, C8 are illustratively used for filtering purposes.

Microprocessor U7 is used in a similar fashion as that of microprocessor U1 of FIG. 5, in controlling the activation/deactivation of LED's 31. Similar to microprocessor U1, microprocessor U7 includes a clocking circuit using oscillator X1 and capacitors C4, C5 coupled thereto. Diode D1 and resistor R3 are used for programming purposes for microprocessor U7. Programmer J4 can be used to program microprocessor U7, however, the microprocessor can be configured to be used without programmer J4. Resistors R13, R14 are used to keep pins 10, 13 of microprocessor U7 from floating during operation. Pin 11 of microprocessor U7 serves as enable line 114, which is connected to pin SHDN of the driver chip U4 of LED driver circuit 40 to activate/deactivate LED's 31 at the desired points. Microprocessor U7 can be programmed to recognize incoming signals, such as that provided by IRLED 32, and execute a task accordingly, such as the activation of LED's 31.

An illustrative embodiment of ambient light detection circuit 112 is shown in FIG. 10. Circuit 112 is used to protect an LED array, such as LED array 100, from the condition of a false trip, which deactivates LED's 31 when it is not desired. This can occur when sensor U3 is exposed to ambient light, which can contain substantial amounts of IR energy, for a significant amount of time. Sensor U3 can become saturated with ambient light, which can cause sensor U3 to act as though it is receiving the infra-red light from itself as described in regard to FIG. 5. Ambient light detector circuit 112 includes a photoresistor U8. Resistor U8 is configured with resistors R18, R20, and R22, as shown in FIG. 10. These resistors can be configured and connected to comparator U6, which provides a high/low output signal. When ambient light is detected by photoresistor U8, the resistance of U8 decreases significantly relative to the resistances of resistors R18-R22. When ambient light is not detected, the resistance of U8 is relatively high compared to the resistances of resistors R18-R22. Each resistor pair shown, R18-U8, R20-R22, is tied to 3 volts, illustratively. The voltages at nodes 116 and 118 are compared by comparator U6. Pin 4 of comparator U6 is the output of the comparison performed. When the resistance of photoresistor U8 is very high, e.g., no ambient light, the output at pin 4 is high. When ambient light is detected, the resistance of U8 drops causing the output at pin 4 to be low. Output line 120 of comparator U6 is connected to pin 9 of microprocessor U7. Resistor R24 is used to bring up the output of microprocessor U6 so that it is detected by microprocessor U7. When microprocessor U7 detects a low signal at pin 9, it recognizes that ambient light is present and will not deactivate LED's 31 if U3 is attempting to deactivate LED's 31 due to receiving ambient light.

This configuration of ambient light detector circuit 112 allows a cabinet door, for example, to be open and LED array 100 activated. If the cabinet door remains open for a significant amount of time ambient light present may saturate U3 with IR light, however the lights are not desired to be shut off because they are still illuminating the cabinet. Ambient light detector circuit 112 will communicate to microprocessor U7 that ambient light is detected, and LED's 31 remain activated. Enable line 114 is connected to pin 11 of microprocessor U7 and pin 3 of driver chip U4. This circuit functions similarly to that described with FIG. 6 based upon the appropriate signals received from microprocessor U6.

Although the present disclosure has been described with reference to particular means, materials and embodiments, from the foregoing description, one skilled in the art can easily ascertain the essential characteristics of the invention and various changes and modifications may be made to adapt the various uses and characteristics without departing from the spirit and scope of the invention.

What is claimed:

1. Apparatus for selectively emitting light to illuminate an enclosed space having a door allowing access thereto, the apparatus comprising:

a plurality of light-emitting diodes (LED's) positioned within said enclosed space;

an infra red (IR) light source;

an IR light sensor for responding to the presence of IR light from the IR light source; and a controller configured to determine when said door is in a first position and control said plurality of LED's based upon the response of said IR light sensor in response thereto;

wherein, the first position is the door being in a closed position;

wherein, the controller is further configured to deactivate the plurality of LED's when the IR sensor responds to the presence of IR light; and wherein, IR light from said IR light source is reflected off of a surface disposed on the door when the door is in the closed position before being received by said IR sensor whereby said plurality of LED's is deactivated.

2. The apparatus of claim 1, wherein:

the IR light sensor responds to the absence of IR light from the IR light source; and the controller is further configured to determine when said door is in a second position and activate said plurality of LED's based upon the IR light sensor responding to the absence of IR light from the IR light source.

3. The apparatus of claim 1, further comprising an ambient light sensor for detecting the presence of ambient light;

wherein said controller is prohibited from deactivating said plurality of light-emitting diodes when ambient light is sensed by said ambient light sensor.

4. The apparatus of claim 2, wherein said controller deactivates said plurality of LED's after said plurality of LED's has been activated for a predetermined amount of time.

5. The apparatus of claim 4, wherein said controller is a microprocessor.

6. Apparatus for selectively emitting light to illuminate an enclosed space having a door allowing access thereto, the apparatus comprising:

a plurality of light-emitting diodes (LED's) positioned within said enclosed space;

an infra red (IR) light source;

an IR light sensor for responding to the presence of IR light from the IR light source;

an ambient light sensor for detecting the presence of ambient light; and a controller configured to determine when said door is in a first position and control said plurality of LED's based upon the response of said IR light sensor in response thereto;

wherein, the first position is the door being in a closed position;

wherein, the controller is further configured to deactivate the plurality of LED's when the IR sensor responds to the presence of IR light; and wherein said controller is prohibited from deactivating said plurality of light-emitting diodes when ambient light is sensed by said ambient light sensor.

7. The apparatus of claim 6, wherein said controller is a microprocessor.

* * * * *